US007676181B2

(12) United States Patent
Ueda et al.

(10) Patent No.: US 7,676,181 B2
(45) Date of Patent: Mar. 9, 2010

(54) DEVELOPING UNIT AND IMAGE FORMING DEVICE

(75) Inventors: Hiroyuki Ueda, Osaka (JP); Hidenori Takenaka, Osaka (JP); Tomoyuki Oda, Osaka (JP); Jumpei Hobo, Osaka (JP); Nobuhiro Horiuchi, Osaka (JP); Koji Murase, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 640 days.

(21) Appl. No.: 11/536,629

(22) Filed: Sep. 28, 2006

(65) Prior Publication Data

US 2007/0077094 A1 Apr. 5, 2007

(30) Foreign Application Priority Data

Sep. 30, 2005 (JP) ..... 2005-287612
Sep. 30, 2005 (JP) ..... 2005-287796

(51) Int. Cl.
*G03G 15/10* (2006.01)

(52) U.S. Cl. ..... 399/239; 399/57; 399/237

(58) Field of Classification Search ..... 399/57, 399/233, 237, 238, 239
See application file for complete search history.

(56) References Cited

U.S. PATENT DOCUMENTS

2005/0147431 A1* 7/2005 Takeuchi et al. ..... 399/237

FOREIGN PATENT DOCUMENTS

| | | |
|---|---|---|
| JP | 5-173410 A | 7/1993 |
| JP | 10-63105 A | 3/1998 |
| JP | 11-65292 A | 3/1999 |
| JP | 2005-196076 A | 7/2005 |

* cited by examiner

*Primary Examiner*—David P Porta
*Assistant Examiner*—Benjamin Schmitt
(74) *Attorney, Agent, or Firm*—Global IP Counselors, LLP

(57) ABSTRACT

The present invention discloses a developing unit that can block unnecessary supply of liquid developer to an image support member and can prevent waste of liquid developer, and an image forming device comprising the same. The developing unit includes a developing member that is in contact with an image support member and supplies the image support member with liquid developer, a developer supply member that supplies the developing member with liquid developer, and an unattached region forming member that forms at least an unattached region that is free of liquid developer on the developing member, the unattached region extending from the contact point between the developing member and the image support member and the contact point between the developing member and the developer supply member.

11 Claims, 4 Drawing Sheets

DEVELOPING UNIT AND IMAGE FORMING DEVICE

CROSS-REFERENCE TO RELATED APPLICATIONS

This application claims priority to Japanese Patent Application No. 2005-287612 and Japanese Patent Application No. 2005-287796. The entire disclosure of Japanese Patent Application No. 2005-287612 and Japanese Patent Application No. 2005-287796 are hereby incorporated herein by reference.

BACKGROUND OF THE INVENTION

1. Field of the Invention

The present invention relates to a developing unit comprising a developing member such as a developing roller that contacts an image support member such as a photosensitive drum charged at a predetermined electric potential and supplies the image support member with liquid developer, and an image forming device comprising the developing unit.

2. Background Information

An image forming device having a developing unit therein that is comprised of a developing roller that contacts a photosensitive drum charged at a predetermined electric potential and supplies the photosensitive drum with liquid developer, and a supply roller that supplies the developing roller with the liquid developer, has been known as a so-called wet image forming device that is typified by a multifunction device and a printer device and performs image formation with liquid developer. In this type of image forming device, the photosensitive drum and the developing roller are in contact with each other. Therefore, even if the photosensitive drum is not charged at a predetermined electric potential, liquid developer attached to the developing roller may still be supplied to the photosensitive drum. Basically, the supply of liquid developer to a portion of the photosensitive drum that is not charged at a predetermined electric potential is unnecessary, and wastes liquid developer.

Japan Patent Application Publication JP-05-173410 discloses a technique for preventing the supply of developer to a photosensitive drum by suspending the driving of a developing roller when the supply of developer to the photosensitive drum is unnecessary (e.g., before image formation). On the other hand, Japan Patent Application Publication JP-2002-287516 discloses a mechanism for separating a developing roller from a photosensitive drum. It is thought that this mechanism will prevent the supply of developer to the photosensitive drum when it is unnecessary.

However, with the technology disclosed in Japan Patent Application publication JP-05-173410, the photosensitive drum is driven while the photosensitive drum contacts the suspended developing roller. Therefore, the photosensitive drum slides in contact with the developing roller, and accordingly the photosensitive drum will become scratched. On the other hand, in a configuration in which the developing roller is repeatedly forced to separate from the photosensitive drum, deviation in the positional relationship between the developing roller and the photosensitive drum will easily occur. Accordingly, this positional deviation will cause deterioration in developing performance.

In view of the above, it will be apparent to those skilled in the art from this disclosure that there exists a need for an improved developing unit that can prevent waste of liquid developer by blocking the unnecessary supply of liquid developer to an image support member, and prevent deterioration in developing performance caused by damage to the image support member and positional deviation of the developing member (e.g., a developing roller and the like), and an image forming device comprising the same. This invention addresses this need in the art as well as other needs, which will become apparent to those skilled in the art from this disclosure.

SUMMARY OF THE INVENTION

In order to achieve the above described object, the present invention is applied to a developing unit that comprises a developing member that is in contact with an image support member charged at a predetermined electric potential and supplies the image support member with liquid developer, and a developer supply member that supplies the developing member with liquid developer. In addition, the developing unit comprises an unattached region forming member that forms at least an unattached region that is free of liquid developer on the developing member, from the contact position between the developing member and the image support member to the contact position between the developing member and the developer supply member.

These and other objects, features, aspects, and advantages of the present invention will become apparent to those skilled in the art from the following detailed description, which taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. Note that it will be apparent to those skilled in the art from this disclosure that the following descriptions of the embodiments of the present invention are provided for illustration only and not for the purpose of limiting the invention as defined by the appended claims and their equivalents.

First Embodiment

Figure 1:
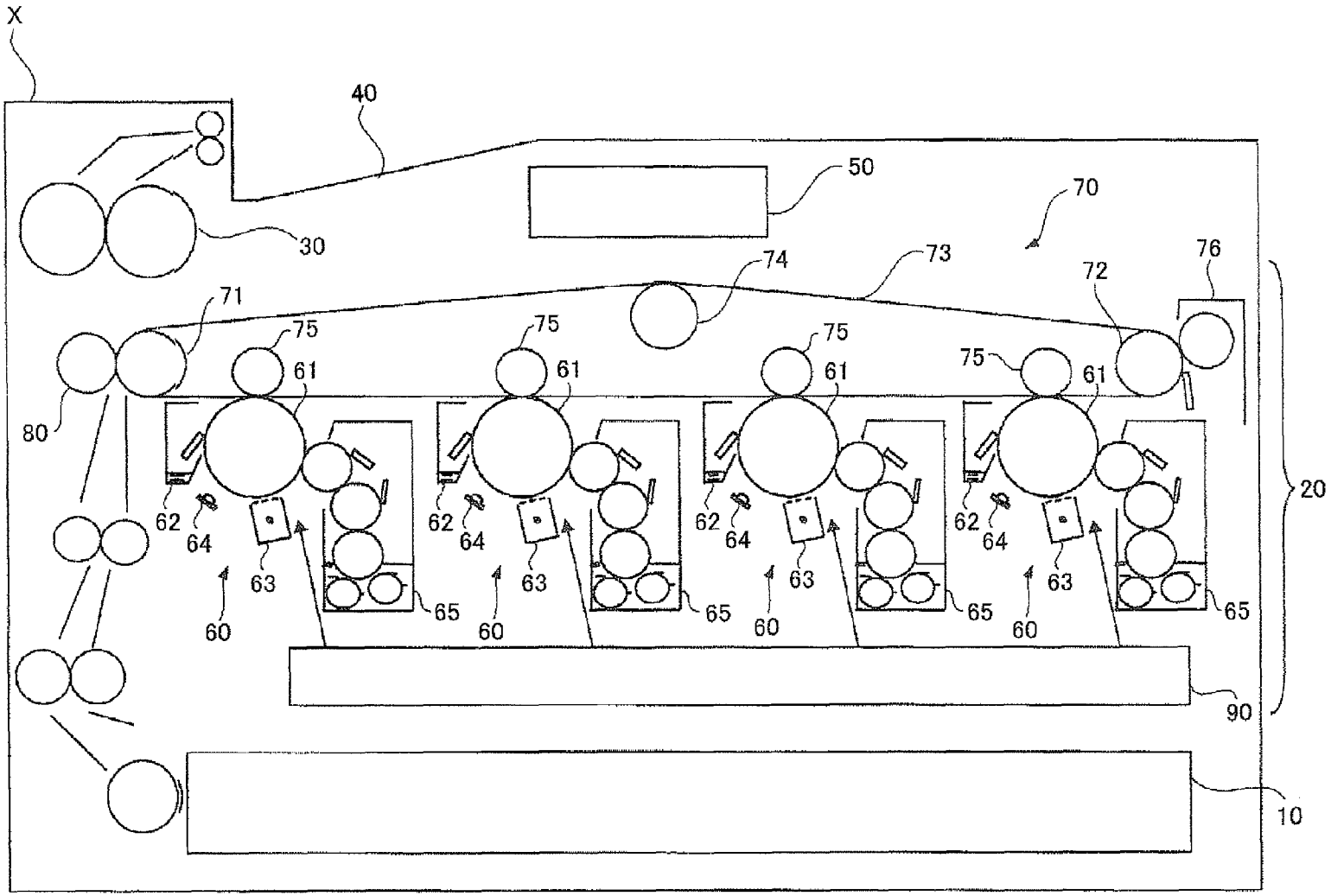
FIG. 1 shows the overall configuration of a color printer in accordance with a first embodiment of the present invention.
Figure 2:
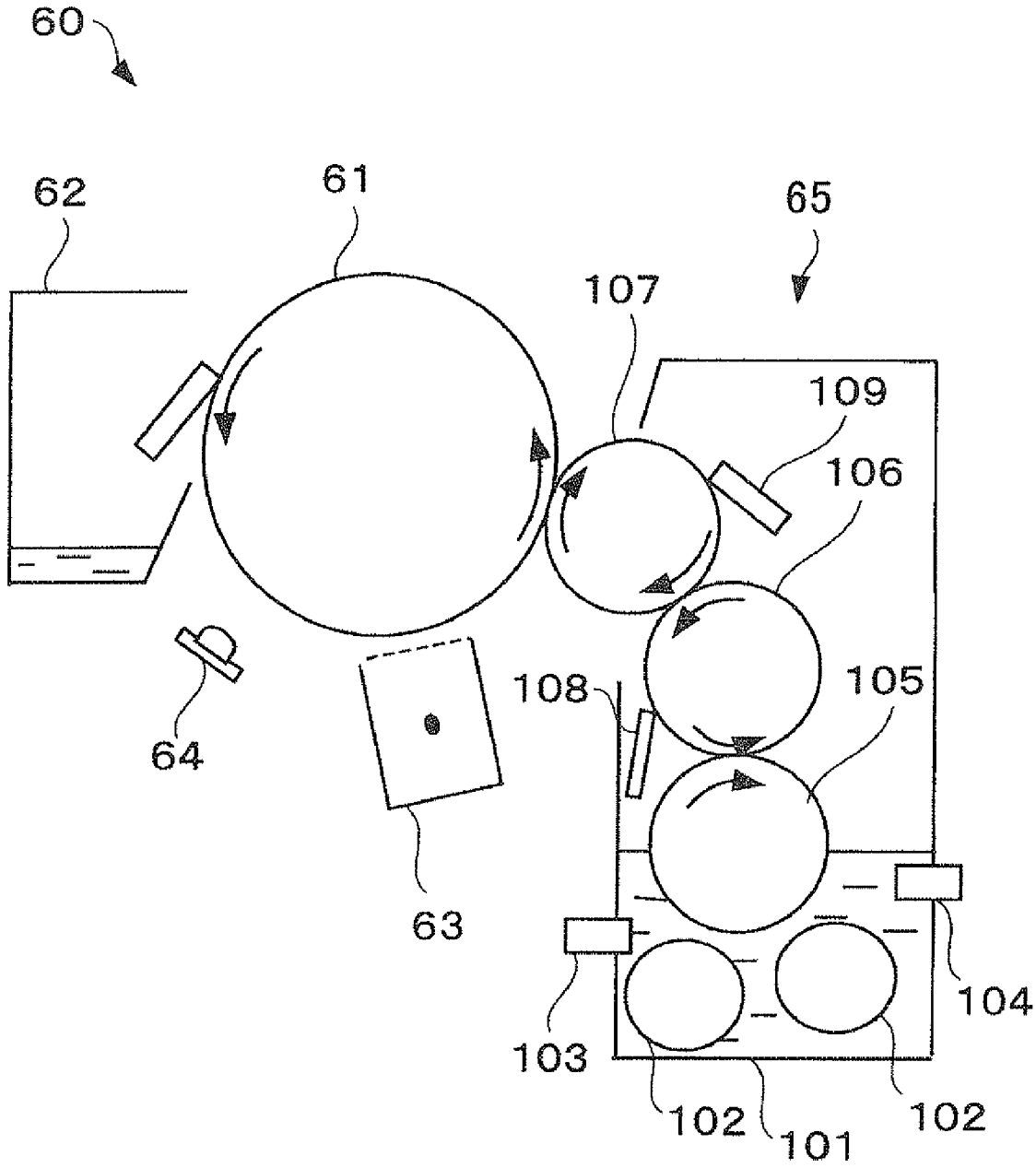
FIG. 2 shows the overall configuration of a developing unit and the vicinity thereof in accordance with a first embodiment of the present invention.

First, an overall configuration of a color printer X in accordance with the first embodiment of the present invention will be explained in reference to FIG. 1. FIG. 1 shows the overall configuration of the color printer X in accordance with the first embodiment of the present invention. FIG. 2 shows the overall configuration of a developing unit 65 and the vicinity thereof in accordance with the first embodiment of the present invention.

The color printer X is a so-called wet image forming device that forms an image on a recording medium (such as a sheet of paper) with liquid developer comprising toner that is comprised of positively charged particles and carrier solution that is comprised of non-polar insulating liquid such as Isopar or silicon oil. Note that a color printer is only an example of an image forming device in accordance with the present invention. In addition, the present invention can also be applied to an image forming device such as a copying machine, a facsimile machine, a multifunction device image, and the like.

As shown in FIG. 1, the color printer X comprises a paper supply cassette 10, an image forming unit 20 that forms a color image or a monochrome image on a recording medium supplied from the paper supply cassette 10, a fixing unit 30 that fixes the image formed on the recording medium by the image forming unit 20, a discharge tray 40 on which the recording medium on which an image is fixed by the fixing unit 30 is discharged, and a control unit 50 that comprehensively controls the color printer X.

The image forming unit 20 comprises four image forming units 60 that provide four colors of toner, e.g., black (BK), magenta (M), cyan (C), and yellow (Y), a laser scanning unit (LSU) 90 that forms an electrostatic latent image on four photosensitive drums 61 (an example of an image support member) that are provided for the four image forming units 60 respectively by exposing the four photosensitive drums 61 with laser light, an intermediate transfer unit 70 that is arranged above the four image forming units 60, and a transfer roller 80.

Each of the four image forming units 60 comprises a photosensitive drum 61 that is comprised of amorphous silicon, a photosensitive drum cleaning unit 62 that removes liquid developer attached to the photosensitive drum 61, an electrostatic charging unit 63 that uniformly charges the photosensitive drum 61 at a predetermined potential, a neutralization unit 64 that removes electric potential from the surface of the photosensitive drum 61, and a developing unit 65 that develops an electrostatic latent image on the photosensitive drum 61 into a toner image with liquid developer. Note that the electric potential of the charged photosensitive drum 61 is set to be approximately +200 to +600 V, for instance. However, it is preferably set to be approximately +300 to +400 V.

The intermediate transfer unit 70 comprises a driving roller 71 that is rotationally driven by a motor (not shown in the drawings), a driven roller 72 that rotates in association with rotation of the driving roller 71, an intermediate transfer belt 73 that is looped around these two rollers, a tension roller 74 that stretches the intermediate transfer belt 73 in order to maintain an appropriate tension, four intermediate transfer rollers 75, each of which transfers the toner image formed on the photosensitive drum 61 to the intermediate transfer belt 73, and a transfer belt cleaning unit 76 that removes liquid developer attached to the intermediate transfer belt 73. Note that the number of the image forming units 60, each of which is comprised of the photosensitive drum 61 and the like, and that of the intermediate transfer rollers 75, is determined according to the number of colors of liquid developer.

The transfer roller 80 is arranged to face the driving roller 71, and transfers the toner image formed on the intermediate transfer belt 73 to the recording medium.

The color printer X in accordance with the first embodiment of the present invention is characterized by the mechanism of the developing unit 65 that supplies liquid developer to the photosensitive drum 61.

In reference to FIG. 2, the developing unit 65 that is mounted to the color printer X is hereinafter explained in detail.

As shown in FIG. 2, each of the developing units 65 comprises a developer storage portion 101 in which liquid developer is stored, two agitation rollers 102 that agitate liquid developer in the developer storage portion 101, a concentration detection sensor 103 that detects the concentration of toner included in liquid developer stored in the developer storage portion 101, a liquid-level detection sensor 104 that detects the liquid level of liquid developer stored in the developer storage portion 101, a drawing roller 105 (an example of a developer supply member), a supply roller 106 (an example of a developer supply member), a developing roller 107 (an example of a developing member), a cleaning blade 108 that removes liquid developer attached to the supply roller 106, and a cleaning blade 109 (an example of a cleaning member) that removes liquid developer attached to the developing roller 107 on the downstream side from the contact position between the photosensitive drum 61 and the developing roller 107 in the rotational direction (i.e., traveling direction) of the developing roller 107.

In the developing unit 65, liquid developer is supplied to the developer storage portion 101 from a developer refill unit (not shown in the drawings) according to the detection results of the concentration detection sensor 103 and the liquid-level detection sensor 104, so as to maintain the predetermined amount and concentration of liquid developer stored in the developer storage portion 101.

Here, a high-voltage power supply (not shown in the figure) applies a bias voltage of approximately +100 to +500 V, more preferably approximately +200 to +300 V, to the supply roller 106 and the developing roller 107, and thus liquid developer will be efficiently transported. Note that the developing roller 107 is only an example of a developing member. A developing member comprised of a belt member may be used instead of using the developing roller 107.

In addition, the supply roller 106 is provided with a stop mechanism (an example of a supply block member, not shown in the drawings) that stops the driving of the supply roller 106. The stop mechanism can stop the driving of the supply roller 106 even during the operation of the developing unit 65. Note that the stop mechanism is comprised of a driving member such as solenoid, a motor, and the like, an engaging member that is driven by the driving member and engages with the supply roller 106, and the like. Furthermore, when the driving of the driving member is controlled by the control unit 50 and the engaging member engages with the supply roller 106, the driving of the supply roller 106 will be stopped.

Note that a driving motor (not shown in the drawings) for driving the supply roller 106 may be separately provided from driving motors (not shown in the drawings) for driving the drawing roller 105, the developing roller 107, and the like, and thus the control unit 50 may be able to control the driving of the supply roller 106 separately from the driving of the drawing roller 105, the developing roller 107, and the like. In this case, it is also possible to stop only the driving of the supply roller 106. In this configuration, the control unit 50 that performs an operation of stopping a driving motor (not shown in the drawings) for driving the supply roller 106 corresponds to the supply block member.

The developing unit 65 will be hereinafter explained more specifically in reference to FIG. 2.

When a developing operation by the developing unit 65 is completed, driving of the supply roller 106 in the developing unit 65 is stopped. Specifically, a driving member of the stop mechanism is controlled by the control unit 50, and driving of the supply roller 106 is stopped. Note that as described above, a configuration in which the control unit 50 stops only a driving motor for driving the supply roller 106 can also be considered as an alternative.

In this way, driving of the supply roller 106 is stopped, and supply of liquid developer to the developing roller 107 from the supply roller 106 is blocked. Note that in a configuration of the developing unit 65 in which a plurality of roller members (i.e., the drawing roller 105 and the supply roller 106) supply the developing roller 107 with liquid developer, the driving of one or more of the roller members may be stopped. For example, the driving of the drawing roller 105 may be stopped. In this case, the supply of liquid developer to the developing roller 107 will be blocked.

On the other hand, even if a developing operation by the developing unit 65 is completed, the control unit 50 will control the driving of the developing roller 107, the photosensitive drum 61, and the like so as to continue operation without being stopped. Because of this, liquid developer remaining on the photosensitive drum 61 and that remaining on the developing roller 107 will be removed by the photosensitive drum cleaning unit 62 and the cleaning blade 109, respectively.

At this point, liquid developer will be supplied to the developing roller 107 from the supply roller 106 if the supply roller 106 is driven. However, as described above, the driving of the supply roller 106 will be stopped at this point. Because of this, supply of liquid developer to the developing roller 107 from the supply roller 106 will not occur. Therefore, the cleaning blade 109 will remove liquid developer from the surface of the developing roller 107, and accordingly an unattached region to which liquid developer is not attached is formed.

Then, if the developing roller 107 completes a full rotation, the driving of the developing roller 107, the photosensitive drum 61, and the like will be stopped. Because of this, the entire surface of the developing roller 107 will be free of liquid developer, and thus the entire surface will be an unattached region. Here, the cleaning blade 109 and the stop mechanism (or the control unit 50) used when stopping the driving of the supply roller 106 comprise an unattached region forming member, for example.

Then, at the start of the next image forming operation in the color printer X, the driving of the photosensitive drum 61, the developing roller 107, and the supply roller 106 is simultaneously started. At this time, in a conventional device, even though a portion of the photosensitive drum 61 that contacts the developing roller 107 is not charged at a predetermined electric potential, a problem will occur in that liquid developer will still be attached to the photosensitive drum 61 through the contact between the photosensitive drum 61 and the developing roller 107.

However, in the developing unit 65 in accordance with the present embodiment of the present invention, at the start of the driving of the developing roller 107, liquid developer will not be attached to at least a portion of the developing roller 107 from the contact position between the developing roller 107 and the photosensitive drum 61 to the contact position between the developing roller 107 and the supply roller 106. Therefore, liquid developer will not be supplied to the photosensitive drum 61 through the portion of the developing roller 107 to which liquid developer is not attached. Because of this, the supply of liquid developer to the photosensitive drum 61 can be blocked when the supply of liquid developer to the photosensitive drum 61 is unnecessary. Accordingly, waste of liquid developer can be prevented. In addition, it is not necessary to stop the driving of the developing roller 107 that is driven while contacting the photosensitive drum 61, as in the conventional art. Therefore, the photosensitive drum 61 will not slidingly contact with the developing roller 107, and thus damage to the photosensitive drum 61 will be prevented.

In addition, the control unit 50 can control the supply roller 106 and the developing roller 107 so that driving of the supply roller 106 can be stopped and the supply of liquid developer to the developing roller 107 can be blocked at the start of the driving of the developing roller 107, and then driving of the supply roller 106 can be started according to a timing when supply of liquid developer to the photosensitive drum 61 is necessary. Thus, liquid developer can begin to be supplied to the developing roller 107. Because of this, the timing of supplying the photosensitive drum 61 with liquid developer can be freely regulated, and an unnecessary supply of liquid developer to the photosensitive drum 61 can be blocked. Thus, waste of liquid developer can be more reliably prevented.

More specifically, the unnecessary supply of liquid developer to an uncharged region (i.e., a region not charged at a predetermined electric potential) of the photosensitive drum 61 can be reliably blocked by controlling the driving timing of the supply roller 106 so that an unattached region to which liquid developer is not attached can be formed in a portion of the developing roller 107, from the contact position between the developing roller 107 and the uncharged region of the photosensitive drum 61 to the contact position between the developing roller 107 and a charged region (i.e., a region charged at a predetermined electric potential) of the photosensitive drum 61.

Then, if the photosensitive drum 61 is charged at a predetermined electric potential, the LSU 90 will start to form an electrostatic latent image, and the developing unit 65 will develop the electrostatic latent image. Note that the formation of the electrostatic latent image by the LSU 90 is started at a timing when the electrostatic latent image reaches the developing roller 107 and contacts an attachment region to which liquid developer is attached.

Note that in the present embodiment, after the developing operation by the developing unit 65 is completed, the developing roller 107 is driven until it completes a full rotation, and the unattached region to which liquid developer is not attached is formed on the entire surface of the developing roller 107. However, the unattached region is not limited to this configuration, and may be formed only on a portion of the developing roller 107 from the contact position between the developing roller 107 and the photosensitive drum 61 to the contact position between the developing roller 107 and the supply roller 106.

Second Embodiment

A second embodiment of the present invention will now be described by focusing on the differences with the above described first embodiment of the present invention. In view of the similarity between the first embodiment and the second to fourth embodiments, the parts of the second to fourth embodiments that are identical to the parts of the first embodiment will be given the same numerals as the parts of the first embodiment. Moreover, the descriptions of the parts of the second to fourth embodiments that are identical to the parts of the first embodiment may be omitted for the sake of brevity.

Figure 3:
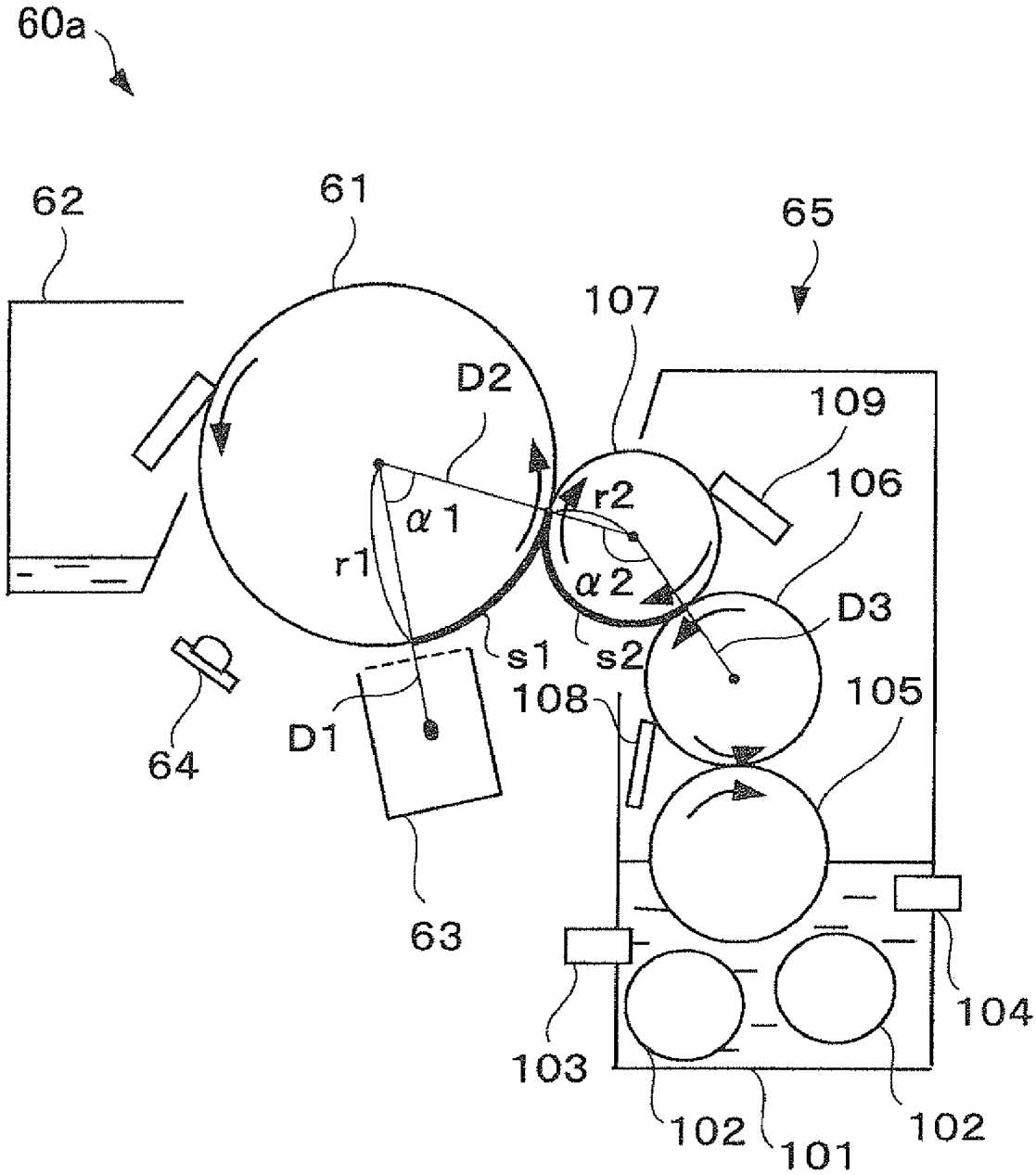
FIG. 3 shows the overall configuration of a developing unit and the vicinity thereof in accordance with a second embodiment of the present invention.

In the second embodiment of the present invention, a color printer X comprises an image forming unit 60*a* in which the electrostatic charging unit 63 and the developing roller 107 in the image forming unit 60 in accordance with the above described first embodiment are arranged as shown in FIG. 3. FIG. 3 shows the overall configuration of the image forming unit 60*a*. Note that elements shown in the second embodiment, which correspond to those described in the above described first embodiment, are given the same numerals as those explained in the first embodiment, and thus a description thereof will be hereinafter omitted.

In the second embodiment, when the developing roller 107 and the photosensitive drum 61 rotate at the same linear speed (i.e., the same travel speed of the outer peripheral surface), if an angle formed by a line D1 connecting the center of an electrostatic charging unit 63 and that of the photosensitive drum 61, and a line D2 connecting the center of a developing roller 107 and that of the photosensitive drum 61, is set to be $\alpha 1$, an angle formed by the line D2 and a line D3 connecting the center of the developing roller 107 and that of a supply roller 106 is set to be $\alpha 2$, the radius of the photosensitive drum 61 is set to be r1, and the radius of the developing roller 107 is set to be r2, the positional relationship between the electrostatic charging unit 63 and the developing roller 107 will be configured so that the relationship "$r1 \cdot \alpha 1 = < r2 \cdot \alpha 2$" is satisfied. In other words, distance s1 (i.e., the bold-faced line shown in FIG. 3) from the position of the outer peripheral surface of the photosensitive drum 61 that is charged by the electrostatic charging unit 63 to the position of the outer peripheral surface of the photosensitive drum 61 on which an electrostatic latent image is developed by the developing roller 107 is less than or equal to distance s2 (i.e., the bold-faced line shown in FIG. 3) from a contact position between the outer peripheral surface of the developing roller 107 and that of the photosensitive drum 61 to a contact position between the outer peripheral surface of the developing roller 107 and that of the supply roller 106.

Note that if the linear speed of the photosensitive drum 61 and that of the developing roller 107 are set to be different from each other, and set to be V1 and V2, respectively, the positional relationship between the electrostatic charging unit 63 and the developing roller 107 may be configured so that the relationship "$r1 \cdot \alpha 1 \cdot V2 = < r2 \cdot \alpha 2 \cdot V1$" is satisfied.

Other configurations, operations, and working effects of the image forming unit 60*a* is the same as those of the image forming unit 60 described in the above described first embodiment of the present invention.

Note that in the present embodiment, after a developing operation by the developing unit 65 is completed, the developing roller 107 is driven until it completes a full rotation, and the unattached region to which liquid developer is not attached is formed on the entire surface of the developing roller 107. However, the unattached region is not limited to this configuration, and may be formed only on a portion of the developing roller 107 (i.e., s2) from the contact position between the developing roller 107 and the photosensitive drum 61 to the contact position between the developing roller 107 and the supply roller 106.

In this case, the distance s1 is less than or equal to the distance s2. Therefore, the supply of liquid developer to a portion of the photosensitive drum 61 (i.e., s1) which is from a point on the photosensitive drum 61 on which an electrostatic latent image is developed by the developing roller 107 to a point on the photosensitive drum 61 at which the photosensitive drum 61 is charged by the electrostatic charging unit 63, will be blocked. Accordingly, waste of liquid developer can be prevented.

Third Embodiment

Another method for blocking the supply of liquid developer to a developing roller 107 will be hereinafter explained.

In the above described first and second embodiments, the method for blocking the supply of liquid developer to the photosensitive drum 61 by stopping the driving of the drawing roller 105 and the supply roller 106 and then stopping the supply of liquid developer stored in the developer storage portion 101 to the developing roller 107 was described.

On the other hand, in order to block the supply of liquid developer stored in a developer storage portion 101 to the photosensitive drum 61, a method for blocking the supply path of liquid developer can be considered. Here, if the developing roller 107 is arranged to be remote from the photosensitive drum 61, as with the conventional art, it is possible to block the supply path of liquid developer to the photosensitive drum 61. However, deviation from the correct position can easily occur in the positional relationship between the developing roller 107 and the photosensitive drum 61. Accordingly, one problem that occurs is that this positional deviation will deteriorate the developing performance.

Therefore, a configuration of an image forming unit is herein proposed that comprises a roller moving mechanism (not shown in the drawings) for separating the supply roller 106 from the developing roller 107 so that liquid developer will not be supplied to the developing roller 107 from the supply roller 106.

It is not necessary to move the developing roller 107 in this configuration, and deviation will not occur in the positional relationship between the developing roller 107 and the photosensitive drum 61. Therefore, it is possible to prevent the developing performance from deteriorating. Liquid developer will not be supplied to the developing roller 107 from the supply roller 106, by separating the supply roller 106 from the developing roller 107 by means of the roller moving mechanism. Therefore, the supply path of liquid developer to the photosensitive drum 61 will be blocked.

Note that in the configuration of the developing unit 65 in which a plurality of roller members (i.e., a drawing roller 105 and the supply roller 106) supply the developing roller 107 with liquid developer, one or more of the roller members may be moved. For example, the drawing roller 105 may be moved. In this case, the supply of liquid developer to the developing roller 107 is blocked.

Fourth Embodiment

Figure 4:
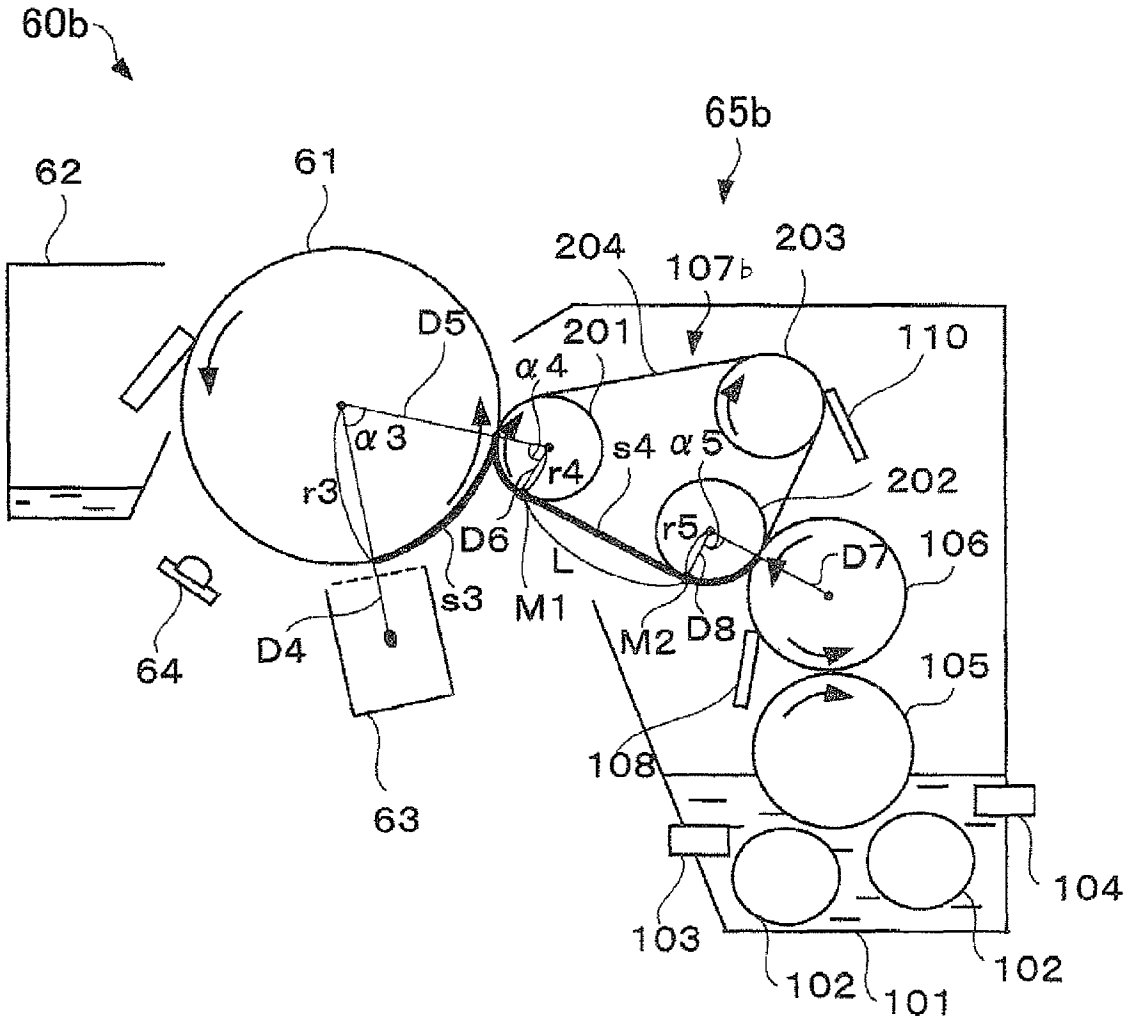
FIG. 4 shows the overall configuration of a developing unit and the vicinity thereof in accordance with a fourth embodiment of the present invention.

In the fourth embodiment of the present invention, a color printer X comprises the image forming unit 60*b* shown in FIG. 4. FIG. 4 shows the overall configuration of the image forming unit 60*b*. Note that elements shown in the fourth embodiment which correspond to those described above in the first embodiment are given the same numerals as those of first embodiment, and thus a description thereof will be hereinafter omitted.

As shown in FIG. 4, a developing unit 65*b* of the image forming unit 60*b* comprises a developing belt mechanism 107*b* instead of the developing roller 107 (shown in FIG. 3) in the developing unit 65 of the sub image forming unit 60*a*. The developing belt mechanism 107*b* is comprised of a driving roller 201 that is rotatably driven by a motor (not shown in the drawings), driven rollers 202 and 203 that rotate in association with the rotation of the driving roller 201, and a developing belt 204 that is looped around these three rollers. Note that liquid developer remaining on the developing belt 204 will be removed by a cleaning blade 110 that contacts with the developing belt 204.

In the image forming unit 60*b* in this configuration, it is possible to prevent waste of liquid developer as with the image forming unit 60 in the above described first embodiment, if the electrostatic charging unit 63 and the developing belt mechanism 107*b* are disposed as follows.

Specifically, when the travel speed of the developing belt 204 and the linear speed (i.e., the travel speed of the outer peripheral surface) of the photosensitive drum 61 are the same, if an angle formed by a line D4 connecting the center of the electrostatic charging unit 63 and that of the photosensitive drum 61 and a line D5 connecting the center of the driving roller 201 and that of the photosensitive drum 61 is set to be $\alpha 3$, an angle formed by the line D5 and a line D6 connecting the center of the driving roller 201 and the wrapping start portion M1 of the developing belt 204 that wraps around the driving roller 201 is set to be $\alpha 4$, an angle formed by a line D7 connecting the center of the driven roller 202 and that of the supply roller 106 and a line D8 connecting the center of the driven roller 202 and the wrapping end portion M2 of the developing belt 204 that wraps around the driven roller 202 is set to be $\alpha 5$, the radius of the photosensitive drum 61 is set to be r3, the radius of the driving roller 201 is set to be r4, radius of the driven roller 202 is set to be r5, and the distance from the wrapping start portion M1 to the wrapping end portion M2 of the developing belt 204 is set to be L, the positional relationship between the electrostatic charging unit 63 and the developing belt mechanism 107*b* is configured so that the relationship "$r3 \cdot \alpha 3 = < (r4 \cdot \alpha 4 + r5 \cdot \alpha 5 + (180/\pi) \cdot L$" is satisfied. In other words, distance s3 (i.e., the bold-faced line shown in FIG. 4) from a point on the outer peripheral surface of the photosensitive drum 61 that is charged by the electrostatic charging unit 63 to a point on the outer peripheral surface of the photosensitive drum 61 on which an electrostatic latent image is developed by the developing belt 204 is less than or equal to distance s4 (i.e., the bold-faced line shown in FIG. 4) from the contact position between the photosensitive drum 61 and the developing belt 204 to the contact position between the supply roller 106 and the developing belt 204.

Note that when the linear speed (i.e., the travel speed of the outer peripheral surface) of the photosensitive drum 61 and the travel speed of the developing belt 204 are different from each other and set to be V3 and V4, respectively, the electrostatic charging unit 63 and the developing belt mechanism 107*b* may be configured so that the relationship "$r3 \cdot \alpha 3 \cdot V4 = < (r4 \cdot \alpha 4 + r5 \cdot \alpha 5 + (180/\pi) \cdot L) \cdot V3$" is satisfied.

As is clear from the above specific explanation, the developing unit in accordance with the present invention comprises a developing member that contacts an image support member charged at a predetermined electric potential and supplies the image support member with liquid developer, and a developer supply member that supplies the developing member with liquid developer. In addition, it comprises an unattached region forming member that at least forms an unattached region to which liquid developer is not attached in a portion of the developing member, located from the contact position between the developing member and the image support member to the contact position between the developing member and the developer supply member.

According to the present invention, it is not necessary to stop the driving of the developing member that contacts with the image support member and to separate the developing member from the image support member in order to prevent waste of liquid developer, which was necessary in the conventional art. Therefore, it is possible to prevent a deterioration in developing performance, which is caused by damage to the image support member and positional deviation of the developing member.

For example, the unattached region forming member forms the unattached region in the developing member after an image forming operation in the image forming device in which the developing unit is arranged. Therefore, the unnecessary supply of liquid developer to the image support member is prevented at the start of the next image forming operation, and thus waste of liquid developer can be prevented.

Furthermore, the unattached region is formed in a portion of the developing member located from the contact position between the developing member and the uncharged region in the image support member to the contact position between the developing member and the charged region in the image support member. Therefore, the unnecessary supply of liquid developer to the image support member can be more reliably prevented.

Specifically, the following can be considered as a method for forming the unattached region in a portion of the developing member located from the contact position between the developing member and the image support member to the contact position between the developing member and the developer supply member. That is, the image forming device is provided with a cleaning member and a supply block member. The cleaning member removes liquid developer attached to the developing member on the downstream side from the contact position between the image support member and the developing member in the travel direction of the developing member. The supply block member blocks the supply of liquid developer to the developing member from the developer supply member. Then, the cleaning member at least removes liquid developer attached to a portion of the developing member located from the contact position between the developing member and the image support member to the contact position between the developing member and the developer supply member, and the supply block member blocks the supply of liquid developer to a region in which liquid developer is removed by the cleaning member.

Note that in order to form the unattached region in a portion of the developing member located from the contact position between the developing member and the uncharged region in the image support member to the contact position between the developing member and the charged region in the image support member, the cleaning member may remove liquid developer attached to a region corresponding to the unattached region, and the supply block member may block the supply of liquid developer to this region.

Here, the supply block member can be considered to be a member for stopping the driving of the developer supply member as an example. In this case, it is not necessary to stop the driving of the developing member. Therefore, it is possible to prevent the image support member that drives in contact with the developing member from being damaged.

Note that if the developer supply member includes one or more roller members, the supply of liquid developer to the developing member can be blocked by stopping the driving of one or more of the roller members.

In addition, the supply block member may be a member for moving the developer supply member to a position in which liquid developer will not be supplied to the developing member. In this case, it is not necessary to move the developing member. Therefore, it is possible to maintain the positional relationship between the image support member and the developing member, and prevent deterioration of the developing performance in the developing unit.

Note that if the developer supply member includes one or more roller members, the supply of liquid developer to the developing member can be blocked by moving one or more of the roller members.

In addition, the present invention can be implemented as an image forming device comprised of an electrostatic charging member that charges the image support member at a predetermined electric potential and a developing unit that is configured as described above.

Furthermore, the present invention can be implemented as an image forming device in which an electrostatic charging member and a developing member are disposed so that the distance from a developing position of an image support member on which an electrostatic latent image is developed by the developing member to a charging position of the image support member that is charged by the electrostatic charging member is less than or equal to the distance from the contact point between the developing member and the image support member to the contact point between the developing member and a developer supply member.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as described by the appended claims and their equivalents. Thus, the scope of the invention is not limited to the disclosed embodiments.

What is claimed is:

1. An image forming device comprising:

an image support member;

an electrostatic charging member configured to charge the image support member at a predetermined electric potential; and a developing unit having a developing member being in contact with the image support member charged at the predetermined electric potential, and configured to supply the image support member with liquid developer, a developer supply member configured to supply the developing member with liquid developer, and an unattached region forming member configured to form an unattached region on the developing member, the unattached region being a region from which liquid developer has been removed, the unattached region extending at least from a first contact point between the developing member and the image support member to a second contact point between the developing member and the developer supply member in a direction opposite a rotation direction of the developing member, the developer supply member being configured to have its rotation stopped while the developing member continues to rotate, the developer supply member being configured to rotate such that its timing is controlled after starting a driving of the developing member in response to an image forming operation to block supply of liquid developer to the image support member to define a second unattached region from a contact position between the developing member and an uncharged region of the image support member to another contact position between the developing member and a charged region of the image support member, the electrostatic charging member and the developing member being arranged so that a first distance extending in a direction opposite a rotation direction of the image support member from a developing position of the image support member at which an electrostatic latent image is developed by the developing member to a charging position of the image support member at which the electrostatic charging member charges the image support member is less than or equal to a second distance extending in a direction opposite the rotation direction of the developing member from the first contact point between the developing member and the image support member to the second contact point between the developing member and the developer supply member.

2. The image forming device according to claim 1, wherein the unattached region forming member includes a cleaning member configured to remove liquid developer attached to the developing member on a downstream side of the first contact point between the first contact point and the second contact point, and a supply block member configured to block the supply of liquid developer to the developing member from the developer supply member;

the cleaning member is configured to remove liquid developer attached to a portion of the developing member that extends from the first contact point between the developing member and the image support member to a third contact point between the developing member and the cleaning member, and the supply block member blocks the supply of liquid developer to the portion on the developing member from which liquid developer was removed by the cleaning member.

3. The image forming device according to claim 2, wherein the supply block member stops the driving of the developer supply member.

4. The image forming device according to claim 3, wherein the developer supply member includes one or more roller members, and the supply block member stops the driving of one or more roller members.

5. The image forming device according to claim 2, wherein the supply block member moves the developer supply member to a position in which liquid developer is not supplied to the developing member.

6. The image forming device according to claim 5, wherein the developer supply member includes one or more roller members, and the supply block member is configured to move one or more of to roller members.

7. The image forming device according to claim 1, wherein the developer supply member is configured to have its rotation stopped when a developing operation is completed, the developing member and the image support member are configured to continue to rotate after the developing operation is completed and the developer supply member has had its rotation stopped, the developing member and the image support member are configured to stop rotating after extending the unattached region to an entire surface of the developing member.

8. An image forming device comprising:

an image support member;

an electrostatic charging member configured to charge the image support member at a predetermined electric potential; and a developing unit having a developing member being in contact with the image support member charged at the predetermined electric potential, and configured to supply the image support member with liquid developer, a developer supply member configured to supply the developing member with liquid developer, and an unattached region forming member configured to form at least an unattached region on the developing member, the unattached region being a region from which liquid developer has been removed, the unattached region extending at least from a first contact point between the developing member and the image support member to a second contact point between the developing member and the developer supply member in a direction opposite a rotation direction of the developing member, the developer supply member being configured to have its rotation stopped while the developing member continues to rotate.

9. The image forming device according to claim 8, wherein the developer supply member is configured to have its rotation stopped when a developing operation is completed, the developing member and the image support member are configured to continue to rotate after the developing operation is completed and the developer supply member has had its rotation stopped, the developing member and the image support member are configured to stop rotating after extending the unattached region to an entire surface of the developing member.

10. An image forming device comprising:

an image support member;

an electrostatic charging member configured to charge the image support member at a predetermined electric potential; and a developing unit having a developing member being in contact with the image support member charged at the predetermined electric potential, and configured to supply the image support member with liquid developer, a developer supply member configured to supply the developing member with liquid developer, and an unattached region forming member configured to form at least an unattached region on the developing member, the unattached region being a region from which liquid developer has been removed, the unattached region extending at least from a first contact point between the developing member and the image support member to a second contact point between the developing member and the developer supply member in a direction opposite a rotation direction of the developing member, the unattached region forming member including a first cleaning member configured to remove liquid developer attached to the developing member on a downstream side of the first contact point between the first contact point and the second contact point, the first cleaning member being configured to remove liquid developer attached to a portion of the developing member extending from the first contact point between the developing member and the image support member to a third contact point between the developing member and the first cleaning member, the developer supply member including a second cleaning member being a cleaning blade and being configured to remove liquid developer attached to the developer supply member, the second cleaning member being configured to contact a portion of the developer supply member configured to contact the developing member.

11. The image forming device according to claim 10, wherein the first cleaning member is a cleaning blade.

* * * * *